US008731441B2

(12) United States Patent
Ishiguro et al.

(10) Patent No.: US 8,731,441 B2
(45) Date of Patent: May 20, 2014

(54) CHARGING ROLLER AND IMAGE FORMING APPARATUS

(75) Inventors: Yasuyuki Ishiguro, Osaka (JP); Hitoshi Nagahama, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 231 days.

(21) Appl. No.: 13/237,318

(22) Filed: Sep. 20, 2011

(65) Prior Publication Data

US 2012/0082482 A1 Apr. 5, 2012

(30) Foreign Application Priority Data

Oct. 1, 2010 (JP) ..... 2010-224267

(51) Int. Cl.
*G03G 15/02* (2006.01)

(52) U.S. Cl.
USPC ..... 399/176; 399/168

(58) Field of Classification Search
USPC ..... 399/168, 176, 109
See application file for complete search history.

(56) References Cited

U.S. PATENT DOCUMENTS

| | | | | |
|---|---|---|---|---|
| 6,721,523 | B2 * | 4/2004 | Sugiura et al. | 399/176 |
| 6,778,797 | B2 * | 8/2004 | Sato et al. | 399/176 |
| 2005/0175374 | A1 | 8/2005 | Kosuge | |
| 2008/0107452 | A1 * | 5/2008 | Kosuge | 399/176 |

FOREIGN PATENT DOCUMENTS

| | | |
|---|---|---|
| CN | 1637644 A | 7/2005 |
| JP | 9-44032 | 2/1997 |
| JP | 2006-293021 | 10/2006 |
| JP | 2008-151883 | 7/2008 |
| JP | 2010-181466 | 8/2010 |

OTHER PUBLICATIONS

Taiyo Wire Cloth Co., Ltd., Products, Electrically-Debonding Adhesive ElectReleaseTM, Online available Jul. 21, 2010, http://www.twc-net.co.jp/catalog/genre/g060/061/post-13.html.

Bankin Kako Eye, "What is knurling? What is knurling processing?" Online available Sep. 10, 2010, http://www.bkeye.com/mach/mach06.html.

Alex Corp., 'Ultrasonic Insert', Online available Sep. 10, 2010, http://www.nalex.co.jp/welder/insert.html.

* cited by examiner

*Primary Examiner* — Sandra Brase
(74) *Attorney, Agent, or Firm* — Nixon & Vanderhye, P.C.

(57) ABSTRACT

A charging roller has a conductive shaft, a charge emission member provided to the shaft, and a gap securing member provided to the shaft. The gap securing member (i) protrudes toward the photoreceptor drum so as to be closer to the photoreceptor drum than the charge emission member is to the photoreceptor drum and (ii) is in contact with the photoreceptor drum so as to secure a gap between the charge emission member and the photoreceptor drum. A conductive part of the gap securing member and the shaft are bonded to each other by electrically releasing adhesive, so that the gap securing member is provided to the shaft.

5 Claims, 4 Drawing Sheets

KNURLING
(STRAIGHT PATTERN)

KNURLING
(CROSS PATTERN)

CHARGING ROLLER AND IMAGE FORMING APPARATUS

This Nonprovisional application claims priority under 35 U.S.C. §119(a) on Patent Application No. 2010-224267 filed in Japan on Oct. 1, 2010, the entire contents of which are hereby incorporated by reference.

TECHNICAL FIELD

The present invention relates to a charging roller to be attached to an electrophotographic image forming apparatus.

BACKGROUND ART

A charging roller, attached to electrophotographic image forming apparatuses so as to charge photoreceptor drums, has been conventionally known. The charging roller has a shaft and a charge emission member (roller main body) attached to the shaft, and charge a photoreceptor drum by means of an electric charge emitted from the charge emission member.

A charging roller, as disclosed in Patent Literature 1, has been conventionally known in which a gap retaining member, attached to a part of a charge emission member, is caused to be in contact with a photoreceptor drum. This allows the photoreceptor drum and the charge emission member to be out-of-contact with each other.

However, such a charging roller has caused a problem that a partial deterioration occurs at a boundary, in the charge emission member, between an area where the gap retaining member is attached and an area where no retaining member is attached. In order to address such a problem, Patent Literature 1 discloses as follows. That is, in a case where an old gap retaining member is released to be replaced by a new one, the new gap retaining member which has an area, to be attached to the charge emission member, larger than the old gap retaining member.

CITATION LIST

Patent Literature

Patent Literature 1

Japanese Patent Application Publication, Tokukai, No. 2008-151883 A (Publication Date: Jul. 3, 2008)

Patent Literature 2

Japanese Patent Application Publication, Tokukai, No. 2006-293021 A (Publication Date: Oct. 26, 2006)

Non Patent Literature

Non Patent Literature 1

Taiyo Wire Cloth Co., Ltd, Products, Electrically-Debanding Adhesive ElectRelease™, Online available Jul. 12, 2010, http://www.twc-net.co.jp/catalog/genre/g060/061/post-13.html

Non Patent Literature 2

Bankin Kako Eye, "What is knurling? What is knurling processing?" Online available Sep. 10, 2010, http://www.bkeye.com/mach/mach06.html

Non Patent Literature 3

Alex Corp., 'Ultrasonic Insert', Online available Sep. 10, 2010, http://www.nalex.co.jp/welder/insert.html

SUMMARY OF INVENTION

Technical Problem

However, every time the gap retaining member of the charging roller described in Patent Literature 1 is replaced, an effective range of a charge emission surface of the charge emission member is reduced. This limits the number of replacements of the gap retaining member and accordingly the number of recycling of the charging roller. This causes a problem that the charging roller cannot be used for a long time.

The present invention is accomplished in view of the problem. An object of the present invention is to provide a charging roller that can be used for a long time.

Solution to Problem

In order to attain the object, a feature of the present invention resides in including: a conductive shaft; a charge emission member provided to the shaft; and a gap securing member, provided to the shaft, which (i) protrudes toward the photoreceptor drum so as to be closer to the photoreceptor drum than the charge emission member is to the photoreceptor drum and (ii) is in contact with the photoreceptor drum so as to secure a gap between the charge emission member and the photoreceptor drum, a conductive part of the gap securing member and the shaft being bonded to each other by electrically releasing adhesive, so that the gap securing member is provided to the shaft.

According to the configuration of the present invention, it is possible to replace the gap securing member with a new one, by applying an electric current between the gap securing member and the shaft so as to release (remove) the gap securing member from the shaft, and then by bonding the new gap securing member to the shaft by means of the electrically releasing adhesive. That is, with the configuration of the present invention, it is possible to replace the gap securing member by a new one, without reducing an effective width of a charge emission surface of the charge emission member. This enables a larger number of replacements of the gap securing member, thereby enabling the charging roller to be used for a long time.

Advantageous Effects of Invention

According to the charging roller of the present invention, it is possible to replace the gap securing member by a new one, without reducing the effective width of the charge emission surface of the charge emission member. This enables a larger number of replacements of the gap securing member, thereby enabling the charging roller to be used for a long time.

DESCRIPTION OF EMBODIMENTS

An embodiment of the present invention will be described below. The following description will mainly discuss a case where the present invention is applied to a monochrome image forming apparatus in the present embodiment. Note that the present invention is not limited to this, and can therefore be applied to a color image forming apparatus.

[Entire Configuration of the Multifunction Printer 10]

Figure 1:
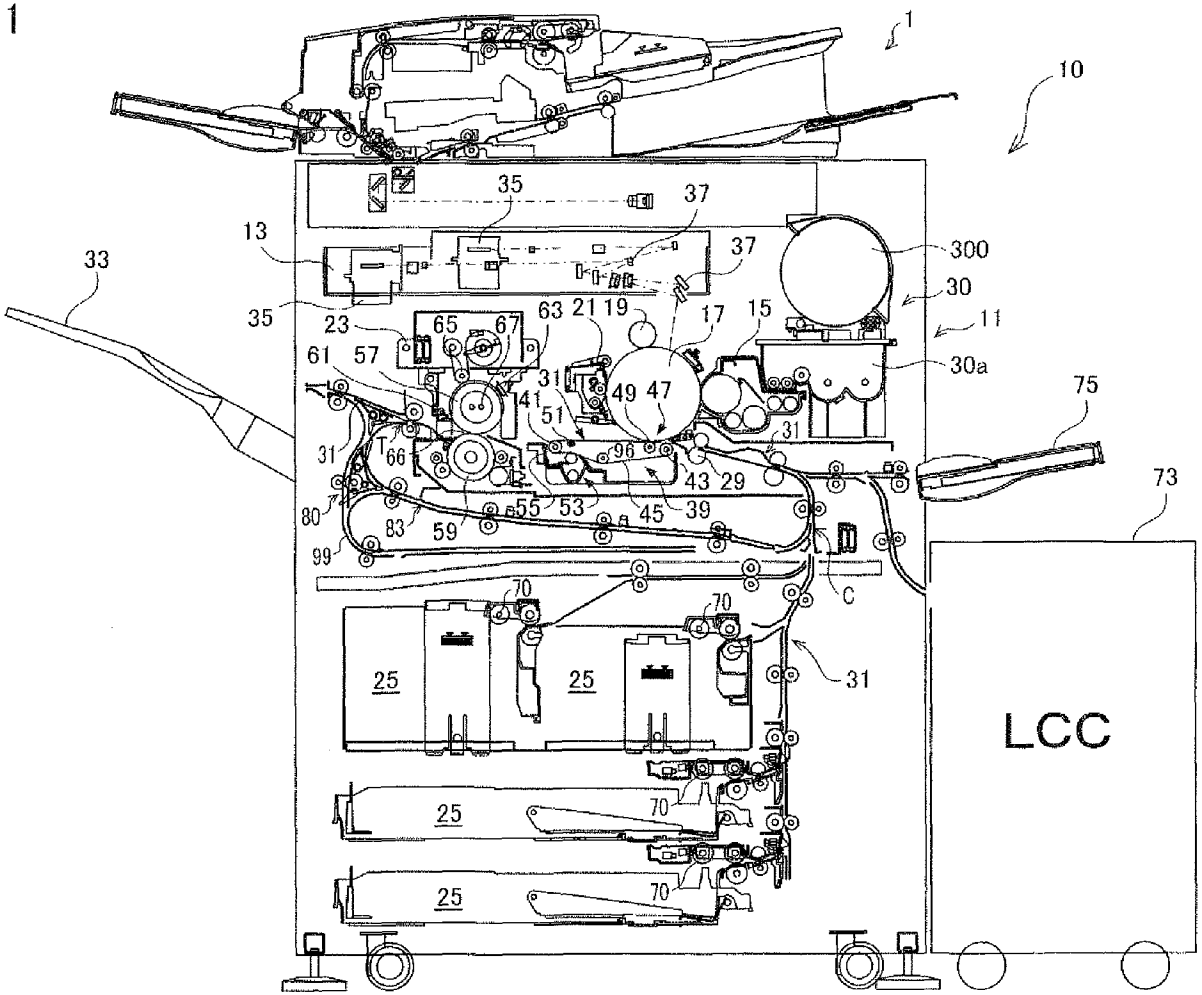
FIG. 1 is a schematic view illustrating an internal arrangement of a multifunction printer in accordance with an embodiment.

FIG. 1 is a cross-sectional view schematically illustrating an entire configuration of a multifunction printer 10 including an image forming apparatus 11 in accordance with the present embodiment. As illustrated in FIG. 1, the multifunction printer 10 includes a scanner 1 and the image forming apparatus 11.

The scanner 1 scans a document so as to obtain an image data of the document. A conventionally known scanner can be used as the scanner 1.

The image forming apparatus 11 forms, on a sheet of paper, an image in accordance with (i) image data obtained by scanning a document by means of the scanner 1, (ii) image data that a communication device (not shown) receives from an external device that is connected to the image forming apparatus 11 via a network so as to communicate with the image forming apparatus 11, or (iii) image data read out from an external storage device (not shown) which is attachable to or detachable from the image forming apparatus 11.

As illustrated in FIG. 1, the image forming apparatus 11 includes an exposure unit 13, a developing device 15, a photoreceptor drum 17, a charging roller 19, a cleaner unit 21, a fixing unit 23, a paper feeding tray 25, a paper carrying path 31, a paper refeeding path 83, a reverse carrying path 99, the paper output tray 33, and the like.

Note that the paper carrying path 31 is provided to extend from the paper feeding tray 25 to the paper output tray 33, via a junction C (a connection point between the paper carrying path 31 and the paper refeeding path 83), an image transferring section 47, and a fixation processing section 66. The paper refeeding path 83 is a carrying path which (i) branches off from a branch point T between the fixing unit 23 and the paper output tray 33 in the paper carrying path 31 and (ii) extends from the branch point T to the junction C. The registration roller 29 is arranged upstream of the image transferring section 47 in the paper carrying path 31.

The charging roller (charging device) 19 is charging means for uniformly charging a surface of the photoreceptor drum 17 at a predetermined electric potential. The charging roller 19 will later be described in detail.

The exposure unit 13 is a laser scanning unit (LSU) including a laser irradiation sections 35 and reflection mirrors 37 (see FIG. 1). Note that the exposure unit 13 is not limited to the LSU but can be a writing head, in which light-emitting elements are arranged in array, such as an electroluminescent writing head or a light-emitting diode writing head.

Note that the LSU can be a single-beam LSU or a multi-beam LSU such as two- or four-beam LSU that is used for the purpose of high-speed printing processing. The present embodiment employs a two-beam LST including two laser irradiation sections 35.

The photoreceptor drum 17, which has been uniformly charged by the charging roller 19, is exposed by the exposure unit 13 in accordance with image data. This allows an electrostatic latent image to be formed on a surface of the photoreceptor drum 17 in accordance with the image data.

The developing device 15 makes the electrostatic latent image, thus formed on the photoreceptor drum 17, visible by developing the electrostatic latent image with the use of toner.

Note that a toner supply device 30 for supplying the developing device 15 with toner is provided near the developing device 15. The toner supply device 30 includes (i) a toner cartridge (toner container) 300 in which toner is contained and (ii) a toner hopper 30*a* which (a) temporarily stores toner supplied from the toner cartridge 300 and (b) appropriately supplies the developing device 15 with the stored toner in response to a decrease in the amount of toner in the developing device 15. Note that the toner cartridge 300 is attachable to or detachable from the multifunction printer 10 so as to be replaced by another when the amount of toner remaining in the toner cartridge decreases.

The toner image (image), made visible on the photoreceptor drum 17, is transferred onto a sheet of paper at the image transferring section 47. The cleaner unit 21 removes and collects toner remaining on the surface of the photoreceptor drum 17 after the image is developed and transferred.

The transfer belt unit 39 transfers a toner image on the photoreceptor drum 17 onto a sheet of paper at the image transferring section 47. An electric field is applied to the transfer belt unit 39 so that the transfer belt unit 39 is electrostatically charged whose polarity is reverse to that of an electric charge of the toner on the photoreceptor drum 17. The electric field causes the toner on the photoreceptor drum 17 to be transferred onto the sheet of paper. When the toner on the photoreceptor drum 17 is negatively charged, an electric field is applied to the transfer belt unit 39 so that the transfer belt unit 39 is positively charged.

The transfer belt unit 39 includes a driving roller 41, a driven roller 43, an elastic conductive roller 49, a roller 96, and a transfer belt 45 which is suspended by and moves in one direction between the respective rollers 41, 43, 49, and 96.

The transfer belt 45 is a belt member whose volume resistance ranges from $1\times10^{9}$ Ω·cm to $1\times10^{13}$ Ω·cm.

The elastic conductive roller 49 for applying a transfer field is provided near an area where (i) the image transferring section 47 is provided and (ii) the photoreceptor drum 17 and the transfer belt 45 are in contact with each other. The elastic conductive roller 49 has elasticity. This causes the photoreceptor drum 17 and the transfer belt 45 to come in surface contact with each other with a predetermined width called a transfer nip, instead of coming into line contact with each other. As such, it is possible to improve the efficiency in transferring of the toner image to a sheet of paper which is to be carried.

Further, a charge removing roller 51 is provided downstream of the image transferring section 47 in a direction in which the transfer belt 45 moves. The charge removing roller 51 removes an electric charge of a sheet of paper which has been electrostatically charged in response to a voltage that was applied while the sheet of paper was passing through the image transferring section 47. This enables the sheet of paper to be smoothly carried in preparation for the next step. The charge removing roller 51 is provided on a back side of the transfer belt 45.

The transfer belt unit 39 further includes (i) a cleaning unit 53 for removing a taint of toner on the transfer belt 45 and (ii) a charge removing mechanism 55 for removing an electric charge from the transfer belt 45. Examples of a charge removal method by the charge removing mechanism 55 encompass (i) a method of grounding the transfer belt 45 via the image forming apparatus 11 and (ii) a method of actively applying, to the transfer belt 45, an electric field whose direction is reverse to a transfer electric field. Note that the sheet of paper onto which the toner image (image) is transferred by the transfer belt unit 39 is carried to the fixing unit 23.

The fixing unit 23 includes a heat roller 57 and a pressure roller 59. A paper peeling claw 61, a thermistor 63 (roller surface temperature sensing member), and a roller surface cleaning member 65 are provided on the periphery of the heat roller 57. A heat source for heating the surface of the roller to a predetermined temperature (a target fixing temperature: approximately 160° C. to 200° C.) is provided inside the heat roller 57.

A mechanism such as a load spring is provided at each end of the pressure roller 59. The mechanism generates a predetermined load which causes the pressure roller 59 to be pressed against the heat roller 57. A paper peeling claw and a roller surface cleaning member are provided on the periphery of the pressure roller 59, as is the case with the heat roller 57.

At a fixation processing section (also called a fixing nip area) 66 that is a pressured section between the heat roller 57 and the pressure roller 59, the fixing unit 23 thermally fixes, onto a sheet of paper, an unfixed toner image on the sheet of paper by means of the surface temperature of the heat roller 57 and the pressing force exerted by the pressure roller 59.

The paper feeding tray 25 is a tray for stacking sheets (recording material) to be used in the printing. In the image forming apparatus 11 of the present embodiment, the paper feeding tray 25 is provided near a side wall of the image forming apparatus and below an image forming section including the photoreceptor drum 17 and the transfer belt unit 39.

Note that the image forming apparatus 11 of the present embodiment includes a plurality of paper feeding trays 25 in each of which 500 to 1500 sheets of paper of a standard-size can be stored so as to enable continuous printing on a large number of sheets of paper. Further, a very large paper feeding cassette 73 and a manual tray 75 are provided on a side surface of the image forming apparatus 11. The very large paper feeding cassette 73 can store a large number of sheets of paper of different sizes. The manual tray 75 is used mainly in printing of uniquely-shaped sheets of paper.

The paper output tray 33 is provided on the side surface opposite to the side surface on which the manual tray 75 is provided. Note that it is possible to remove the paper output tray 33 and optionally provide a post-processing device (stapling, punching etc.) for an outputted sheet of paper or a multistage paper output tray.

The following description will discuss a paper carrying path used when printing process is carried out in the image forming apparatus 11.

When a printing request (printing request command) is entered to the image forming apparatus 11, a pickup roller 70 picks up a sheet of paper from a paper feeding tray 25 which stores sheets of paper meeting the printing request, and then supplies a picked-up sheet of paper to the paper carrying path 31. Then, the picked-up sheet of paper is carried via the junction C and brought to a halt at the registration roller 29 provided upstream of the image transferring section 47 in the paper carrying path 31.

Subsequently, the registration roller 29 resumes rotating at a timing when an end of the sheet of paper matches, at the image transferring section 47, an end of the toner image (image) on the photoreceptor drum 17. This causes the sheet of paper to be carried to the image transferring section 47. At the image transferring section 47, the toner image on the photoreceptor drum 17 is transferred onto a surface (right face) of the sheet of paper. The sheet of paper is further guided to the fixing unit 23, where the toner, which has been transferred onto the sheet of paper, is (thermally) fixed on the sheet of paper.

After this, the paper carrying path is switched depending on whether the image forming apparatus 11 is in a single-side printing mode or in a both side printing mode. Specifically, in the single-side printing mode, a gate of the carrying path switching mechanism 80 shown in FIG. 1 is switched in a direction so that a sheet of paper discharged from the fixing unit 23 is carried to the paper output tray 33 after the sheet of paper is turned over. In the both side printing mode, the gate of the carrying path switching mechanism 80 is switched in a direction so that a sheet of paper discharged from the fixing unit 23 is fed into the paper refeeding path 83 after the sheet of paper is turned over. The sheet of paper, which has been fed into the paper refeeding path 83, passes though the paper refeeding path 83 and is fed back into the paper carrying path 31 via the junction C. Subsequently, the sheet of paper is carried back to the image transferring section 47, where an image is transferred onto the back face of the sheet of paper. Then, the sheet of paper is discharged to the paper output tray 33 via the fixing unit 23.

[Configuration of the Charging Roller 19]

Figure 2:
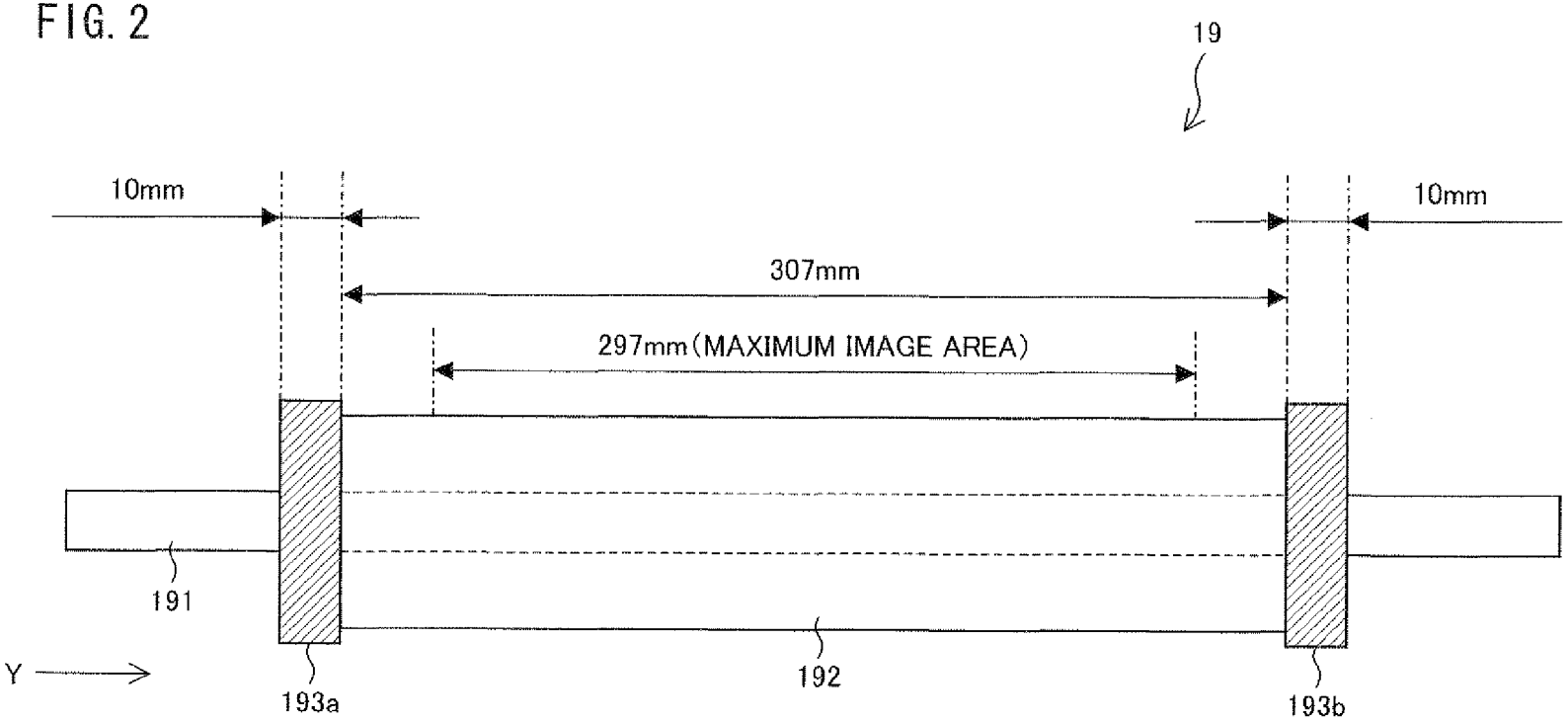
FIG. 2 is a view schematically illustrating a charging roller in accordance with an embodiment.

Next, the charging roller 19 of the present embodiment will be described in detail. As illustrated in FIG. 2, the charging roller 19 has a shaft (shaft core) 191, a charge emission member 192, and gap securing members 193*a* and 193*b*. The gap securing member 193*a*, the charge emission member 192, and the gap securing member 193*b* are attached to the shaft 191 so as to be arranged in this order from an end of the shaft 191 to the other end. Note that, in the following description, 'the gap securing member 193' intends to mean both the gap securing members 193*a* and 193*b*.

The shaft (cored bar) 191 supports the charge emission member 192 and is a columnar member having an outer diameter of ϕ8 mm and made of a conductive metal. The shaft 191 of the present embodiment is made of stainless steel (SUS). Note, however, that the shaft 191 is not limited to stainless steel, provided that it is a conductive metal.

Figure 3:
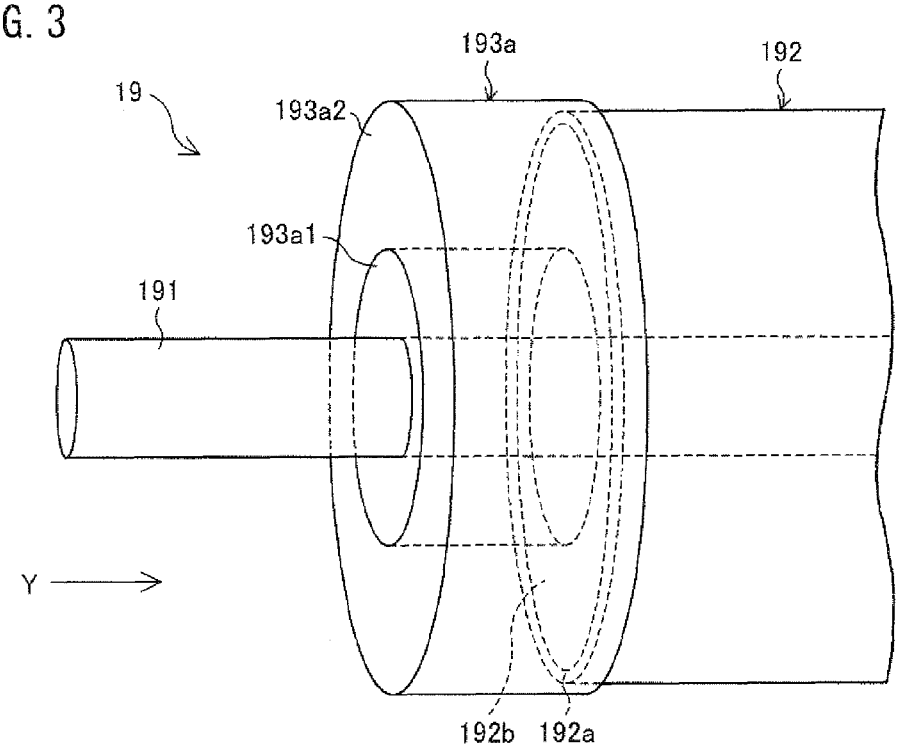
FIG. 3 is an enlarged perspective view schematically illustrating an end of the charging roller illustrated in FIG. 2

The charge emission member 192 is a cylindrical member with an outer diameter of ϕ30 mm and has an inner circumferential surface fixed to the shaft 191. The charge emission member 192 charges the photoreceptor drum 17 by emitting an electric charge toward the photoreceptor drum 17 when a D.C. voltage is applied. As illustrated in FIG. 3, the charge emission member 192 is configured by (i) an elastic layer 192*b* covering the circumferential surface of the shaft 191 and (ii) a surface layer 192*a* covering an outer circumferential surface of the elastic layer 192*b*. The elastic layer 192*b* of the charge emission member 192 is made of silicone rubber containing a conductive agent. The surface layer 192*a* of the charge emission member 192 is made of urethane resin obtained by cross-linking acrylic polyol with isocyanate. Note that an elastic roller of example 9 described in Patent Literature 2 can be used as the charge emission member 192. Also note that a conductive agent described in paragraph 0033 of Patent Literature 2 can be used as the conductive agent. The surface layer 192*a* can contain a conductive agent.

If an image area of a maximum printable size in the image forming apparatus 11 is referred to as a maximum image area, a length of the maximum image area in the Y direction is 297 mm (see FIG. 2). Accordingly, in the present embodiment, a length of the charge emission member 192 in the Y-direction is set to 307 mm (see FIG. 2), and positioning of the charging roller 19 is made so that the charge emission member 192 always faces an area, above the photoreceptor drum 17, corresponding to the maximum image area. Note that the Y-direction is parallel to a main scanning direction for an image formed in the image forming apparatus 11. The Y-direction is also parallel to the shaft of the charging roller 19 and a rotary shaft of the photoreceptor drum 17.

The gap securing member 193 (i) is a cylindrical member having a length of 10 mm in the Y-direction and an outer diameter of ϕ31.2 mm, (ii) has an inner circumferential surface fixed to the shaft 191, and (iii) has an outer circumferential surface which is in contact with an outer circumferential surface of the photoreceptor drum 17. Since the gap securing member 193 is in contact with the photoreceptor drum 17, a gap (space) is secured between the charge emission member 192 and the photoreceptor drum 17.

That is, a length of the charging roller 19 from the center of rotation thereof to the outer circumferential surface of the charge emission member 192 (i.e., a length in a direction perpendicular to Y-direction) is 15 mm, whereas a length of the charging roller 19 from the center of rotation thereof to the outer circumferential surface of the gap securing member 193 (i.e., a length in a direction perpendicular to the Y-direction) is 15.6 mm. Because of this, the gap securing member 193 protrudes toward the photoreceptor drum 17 so as to be closer, by 0.6 mm, to the photoreceptor drum 17 than the charge emission member 192 is to the photoreceptor drum 17. The 0.6 mm gap is secured between the charge emission member 192 and the photoreceptor drum 17, due to the fact that the outer circumferential surface of the gap securing member 193 is in contact with the outer circumferential surface of the photoreceptor drum 17.

Next, a structure of the gap securing member 193 will be described in detail. FIG. 3 is a partial perspective view illustrating an upstream side of the charging roller 19 of the present embodiment in the Y-direction. Note that the description of the gap securing member 193*b* will be omitted and only the gap securing member 193*a* will be described. This is because (i) FIG. 3 shows the gap securing member 193*a* but not the gap securing member 193*b* and (ii) the gap securing member 193*a* and the gap securing member 193*b* have identical structure and function.

As illustrated in FIG. 3, the shaft 191 is fitted into the gap securing member 193*a* so that the gap securing member 193*a* is adjacent to the charge emission member 192, and the gap securing member 193*a* is fixed to and supported by the shaft 191. Note that the gap securing member 193*a* is in contact with but not fixed (adhered) to the charge emission member 192.

As illustrated in FIG. 3, the gap securing member 193*a* has a ring conductive member (metal member) 193*a*1 made of a conductive metal and a ring resin member 193*a*2.

The resin member 193*a*2 can be made of any one of polyacetal (POM) resin, ABS (acrylonitrile butadiene styrene) resin, and polycarbonate resin. The polyacetal resin is preferable in terms of strength, elasticity, and impact resistance. It is only necessary that the conductive member 193*a*1 be made of conductive metal. The conductive member 193*a*1 can therefore be made of stainless steel just as the shaft 191, brass, die-cast aluminum (aluminum), or surface-treated (electroless nickel plating, unichrome plating, chromium plating, etc.) iron. Note that the conductive member 193*a*1 is preferably made of nonmagnetic stainless steel, brass, or die-cast aluminum in a case where magnetic toner is used in the image forming apparatus 11.

The conductive member 193*a*1 is press fitted in a through-hole on an inner circumferential side of the resin member 193*a*2 so that an outer circumferential surface is in close contact with an inner circumferential surface of the resin member 193*a*2. The shaft 191 is inserted in a through-hole on an inner circumferential side of the conductive member 193*a*1. The inner circumferential surface of the conductive member 193*a*1 and the shaft 191 are bonded to each other via electrically releasing adhesive (described later). In this manner, the gap securing member 193*a* configured by the conductive member 193*a*1 and the resin member 193*a*2 is fixed to and supported by the shaft 191.

An outer diameter of the conductive member 193*a*1 and an inner diameter of the resin member 193*a*2 are designed so that the conductive member 193*a*1 is secured to the resin member 193*a*2 by being press fitted to the inner circumferential side of the resin member 193*a*2.

Figure 5A:
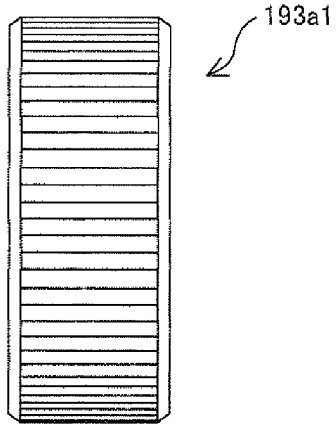
FIG. 5(*a*) of FIG. 5 is an explanatory view illustrating a surface knurled to have a straight pattern, and (*b*) of FIG. 5 is an explanatory view illustrating a surface knurled to have a cross pattern.
Figure 5B:
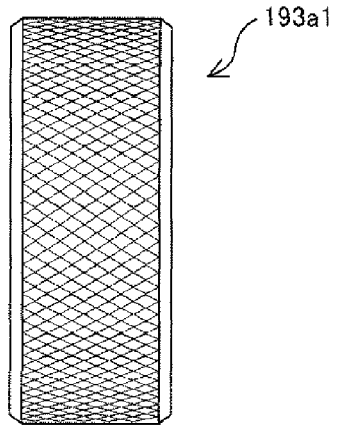

Further, the outer circumferential surface of the conductive member 193*a*1 is knurled. Note that the knurling is not limited to a specific one, provided that it is defined by JISB0951. That is, the outer circumferential surface of the conductive member 193*a*1 can be knurled to have a straight pattern as illustrated in FIG. 5(*a*), or can be knurled to have a cross pattern as illustrated in FIG. 5(*b*). Note that the specifications given in Non patent Literature 2 can be employed for a shape and size of grooves of the knurles.

Figure 4:
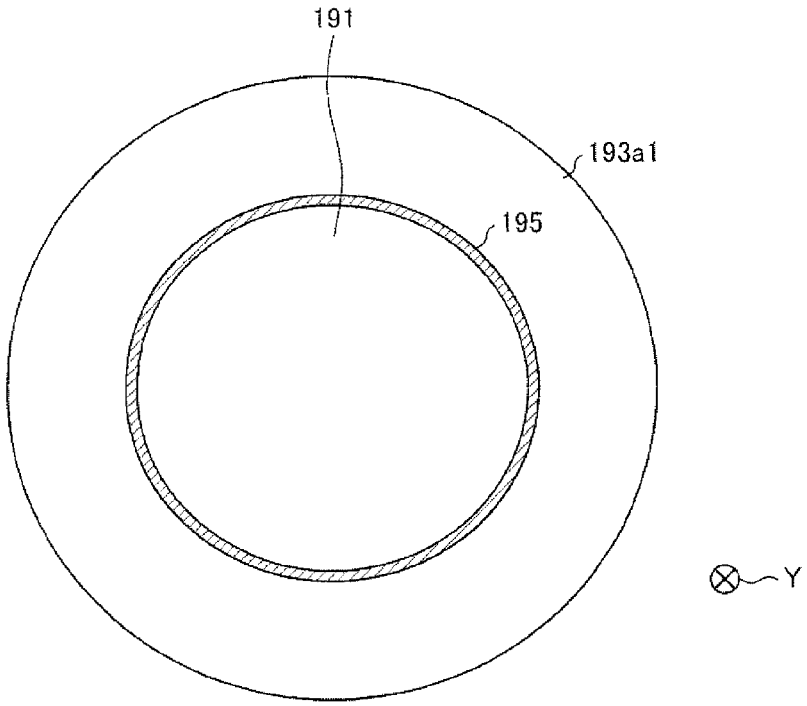
FIG. 4 is a view illustrating a shaft and a conductive member illustrated in FIG. 3, which view is obtained when they are viewed from upstream in a Y-direction.

In the present embodiment, the electrically releasing adhesive is applied to at least one of the inner circumferential surface of the conductive member 193*a*1 and the outer circumferential surface of the shaft 191, so that the inner circumferential surface of the conductive member 193*a*1 and the outer circumferential surface of the shaft 191 are bonded to each other. This secures an adhesion layer 195 of 0.05 mm in thickness between the inner circumferential surface of the conductive member 193*a*1 and the outer circumferential surface of the shaft 191 as illustrated in FIG. 4. (Note that the shaft 191 has an outer diameter of ϕ8 mm, and the conductive member 191 has an inner diameter of ϕ8.1 mm.)

The electrically releasing adhesive (electrically-debonding adhesive) is an adhesive having a property in which adhesive strength is lowered in response to an electric current being applied and resultantly an interface between an adhered body (thing to be adhered) and the adhesive is released. In the present embodiment, ElectRelease E4 manufactured by Taiyo Wire Cloth Co., Ltd is used as the electrically releasing adhesive (see Non patent Literature 1 and product information described in Non patent Literature 1). The electrically releasing adhesive has the following property. When a D.C. voltage of 5 V to 50 V is applied, for about 10 seconds to a few minutes, between a first adhered body and a second adhered body which are bonded to each other via the adhesive, an electrochemical reaction is caused at an interface between the adhesive and the first adhered body to which an anode is connected. The electrochemical reaction lowers adhesive strength, and accordingly the interface is released. At a normal temperature, the electric current, which flows between the first adhered body and the second adhered body, (i) is more than 5 mA/cm$^2$ immediately after the voltage starts to be applied, (ii) decreases to approximately 1 mA/cm$^2$ about a few seconds later, and (iii) further reduces to and becomes constant, i.e., about 0.1 mA/cm$^2$ a few minutes later. Note that it is possible that (a) the interface between the first adhered body and the adhesive and (b) the interface between the second adhered body and the adhesive are both released by reversing the polarity of a voltage to be applied between the first adhered body and the second adhered body. The electrically releasing adhesive has additional property in which (i) no adhesion layer is left on the surface of a base metal after the electrically releasing adhesive is released from the base metal and (ii) no gas or heat is generated while the electrically releasing adhesive is being released from the base metal.

Figure 6:
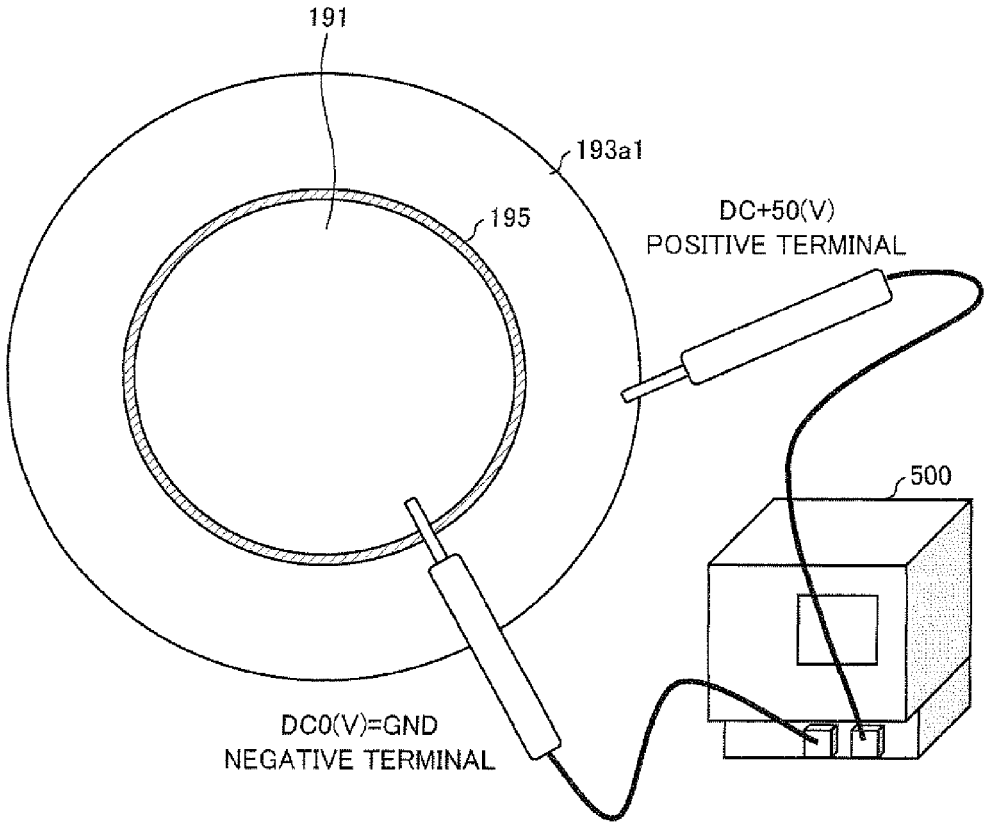
FIG. 6 is an explanatory view illustrating how a gap securing member is released from a shaft of a charging roller.

Next, with reference to FIG. 6, the following description will discuss a procedure for replacing the gap securing member 193*a*, which is to be attached to the shaft 191, during recycling of the charging roller 19. FIG. 6 illustrates a step of removing the gap securing member 193*a* from the shaft 191.

In a case where the gap securing member 193*a* is removed from the shaft 191, (i) one of the adhered bodies, that is, one of the shaft 191 and the conductive member 193*a*1, is brought into contact with a positive terminal of a DC power source 500 and (ii) the other of the adhered bodies is brought into contact with a negative terminal of the DC power source 500. This causes a release between the adhesion layer 195 and the adhered body that is brought into contact with the positive terminal of the DC power source 500. Subsequently, the one of the adhered bodies is brought into contact with the negative terminal and the other of the adhered bodies is brought into contact with the positive terminal. This allows (i) the shaft 191 to be released from the adhesion layer 195 and (ii) the conductive member 193*a*1 to be released from the adhesion layer 195. Thus, the gap securing member 193*a* including the conductive member 193*a*1 can be removed from the shaft 191. Then, a new gap securing member 193*a* is bonded to the shaft 191 by use of the electrically releasing adhesive, and the gap securing member 193*a* replacement operation is completed.

As described above, the charging roller 19 of the present embodiment includes the conductive shaft 191; the charge emission member 192 provided to the shaft 191; and the gap securing member 193, provided to the shaft 191, which (i) protrudes toward the photoreceptor drum 17 so as to be closer to the photoreceptor drum 17 than the charge emission member 192 is to the photoreceptor drum 17 and (ii) is in contact with the photoreceptor drum 17 so as to secure a gap between the charge emission member 192 and the photoreceptor drum 17. A conductive member (conductive part) of the gap securing member 193 and the shaft 191 are bonded to each other by electrically releasing adhesive, so that the gap securing member 193 is provided to the shaft 191. With the configuration, it is possible to replace the gap securing member 193 with a new one, by applying a current between the gap securing member 193 and the shaft 191 so as to cause the gap securing member 193 to be removed from the shaft 191, and then by bonding a new gap securing member 193 to the shaft 191 by use of the electrically releasing adhesive. That is, with the configuration of the present embodiment, it is possible to replace the gap securing member 193 by a new one, without reducing an effective width of a charge emission surface of the charge emission member 192. This enables a larger number of replacements of the gap securing member 193, thereby enabling the charging roller 19 to be used for a long time.

Either a first method or a second method can be employed as a method of rotating the charging roller 19 in the image forming apparatus 11. According to the first method, mere frictional force, between the photoreceptor drum 17 which is rotating and the gap securing member 193, causes the charging roller 19 to be rotated in response to the rotation of the photoreceptor drum 17. According to the second method, the charging roller 19 is rotated by (i) the frictional force between the photoreceptor drum 17 which is rotating and the gap securing member 193*a* and (ii) a torque that is transmitted via a drive gear, provided in the image forming apparatus 11, for transmitting (giving) to the shaft 191 the torque generated by a driving source of the image forming apparatus 11. Note that, in the second method, the charging roller 19 can have a circumferential velocity substantially equal to that of the photoreceptor drum 17. This allows a reduction in the frictional force between the photoreceptor drum 17 and the gap securing member 193. It is therefore possible to prevent the photoreceptor drum 17 from being scratched.

(Developer Used in the Multifunction Printer 10)

The following description will discuss properties of a developer used in the multifunction printer 10 of the present embodiment.

The developer in the developing device 15 of the present embodiment preferably contains carriers of a median diameter based on volume (particle size based on volume ($D_{50}$)) of 15 μm to 70 μm, more preferably contains carriers of a median diameter of 25 μm to 60 μm, and most preferably contains carriers of a median diameter of 30 μm to 55 μm.

In a case where carriers of a volume-average median size of less than 15 μm are used, a magnetic brush (chain) on a development sleeve forms uniform and dense bristles but is at the same time short in length. Because of this, a gap between the photoreceptor drum and the development sleeve must be set very small (e.g. 0.1 mm to 0.3 mm). This requires a very expensive developing device. Further, the use of the carriers of a volume-average median size of less than 15 μm causes a tendency to deteriorate fluidity of the developer and impede charging of the supplied toner. Still further, the use of the carriers of a volume-average median size of less than 15 μm causes a tendency for carrier adherence to easily occur due to line symmetrical charges of the photoreceptor and the carriers. This impedes stable formation of a toner layer on the development sleeve and may therefore cause the photoreceptor to be subjected to a minor scratch.

In contrast, in a case where carriers of a volume-average median size of more than 70 μm are used, a magnetic brush of the developer forms bristles that are long in length. This causes the developer to have nonuniform brushing (a phenomenon in which uniform magnetic brushes get hard to be formed and the surface formed by the brush tips gets coarse), so that image quality is deteriorated. Further, since the carriers with a small specific surface area cannot sufficiently charge the toner, the magnetic brushes are apt to get rigid. This may cause nonuniform brushing in a developer layer on the development sleeve and make it impossible to obtain a good image.

Note that the developer in the developing device 15 of the present embodiment preferably contains carriers having a true specific gravity of 3.0 g/cm$^3$ to 3.8 g/cm$^3$. This is preferable because a two component developer containing carriers in such a true specific gravity range has a small load on the toner and prevents the carriers from causing toner spent even when the two component developer is stirred and mixed. In the case of using the carriers having such a true specific gravity of 3.0 g/cm$^3$ to 3.8 g/cm$^3$, a good toner layer can be easily formed on the development sleeve and it is difficult for the photoreceptor to be scratched even when the developer adheres to the development sleeve and the photoreceptor. This is another reason why it is preferable to use the carriers having such a true specific gravity of 3.0 g/cm$^3$ to 3.8 g/cm$^3$. In a case of using the supply developer containing carriers having such a true specific gravity of 3.0 g/cm$^3$ to 3.8 g/cm$^3$, the developer is stably supplied. Note that the true specific gravity of the carriers can be adjusted by appropriately selecting manufacturing conditions such as a type of material, a composition ratio, and a calcining temperature during production of a core.

Further note that the developer in the developing device 15 of the present embodiment preferably contains carriers having a magnetization σ1000 of 40 $Am^2/kg$ to 70 $Am^2/kg$, more preferably contains carriers having a magnetization σ1000 of 50 $Am^2/kg$ to 70 $Am^2/kg$, and most preferably contains carriers having a magnetization σ1000 of 55 $Am^2/kg$ to 65 $Am^2/kg$. Note that a magnetization σ1000 is an intensity of magnetization under a magnetic field of 1000 oersted (1000/4π (kA/m)).

The use of the carriers having a magnetization σ1000 of 40 $Am^2/kg$ to 70 $Am^2/kg$ prevents the carriers from adhering to the development sleeve and the photoreceptor. This improves durability of a two component developer containing the carriers.

Note that, in a case of using carriers having a magnetization σ1000 of more than 70 $Am^2/kg$, toner adhering to the magnetic brush is greatly stressed. This may cause the toner to deteriorate easily. The carriers having such a magnetization σ1000 of more than 70 $Am^2/kg$ may easily suffer toner spent. Further, in a case of using carriers having a magnetization σ1000 of less than 40 $Am^2/kg$, even substantially spherical carriers are easily adhere to the development sleeve and/or the photoreceptor because a magnetic binding force exerted on the development sleeve is weak. This may narrow a range (latitude) of voltages that enable a photographic fog to be removed.

Note that the magnetization σ1000 can be adjusted by appropriately selecting a type and amount of a magnetic substance to be contained.

The magnetization σ1000 can be measured in the following procedure by use of an oscillating magnetic field-type magnetic property automatic recording apparatus BH V-30 manufactured by Riken Denshi Co., Ltd. According to the procedure, a cylindrical plastic container is sufficiently densely filled with carriers. At the same time, an external magnetic field of 1000 oersted is generated, and then (i) a magnetic moment of the carriers filled in the container and (ii) an actual mass of the carriers filled in the container are measured. The magnetization σ1000 ($Am^2/kg$) is found based on the magnetic moment and the mass which are measured.

Note that it is preferable that a carrier core of the carrier have a porous shape and contains ferrite, in view of excellent productivity. The carrier core containing ferrite is preferable because, even if the content of resin increases so that a specific gravity is reduced, a hole of the carrier core is impregnated with the resin, so that the adhesion of a layer to which the resin is added resin to the carrier core is improved. Note that the carrier core having a porous shape denotes a carrier core that has a hole inside the core or in the surface layer of the core. The carrier core having a porous shape can be produced by such a method in which a sintering temperature is set low so as to suppress a crystal growth or a method in which a hole forming agent such as a foaming agent is added so as to produce a hole in the carrier core.

Note that the toner in the developer of the present embodiment can contain transparent toner. In this case, the transparent toner is born on the sheet of paper and color toner is superimposed on the transparent toner, so that a high-resolution color toner image can be obtained. This is for the purpose of reducing an influence of an uneven surface of a sheet of paper so that color reproducibility and glossiness can be improved with a smaller amount of color toner (black toner). That is, a sheet of recording paper is laminated with so called transparent toner in advance so as to eliminate unevenness on the surface of the recording paper.

Examples of the transparent toner encompass particles which are of resin having high optical transparency and containing substantially no coloring agent, have a number-average particle diameter (number mean particle diameter) of 1 μm to 25 μm, are substantially colorless, and transmit at least visible light well through the particles without substantially scattering the visible light.

Note that a given ingredient can be added if necessary. For example, addition of wax, a fatty acid, or a metallic salt of a fatty acid makes it easier to form a uniform film while the transparent toner is being melted with heat so as to be fixed. This allows an image with improved transparency and excellent surface gloss, and also allows an offset prevention effect brought about during the fixation process by means of the heat roller. Alternatively, silica, alumina, titania, particles of organic resin, or the like can be added as an external additive so as to ensure the fluidity and charging property of the toner.

The image forming apparatus 11 of the present embodiment is a monochrome printer but can alternatively be a color image forming apparatus. In a case of the color image forming apparatus, not only the black toner is used but also yellow toner, magenta toner, and cyan toner are used to form a color image. Alternatively, black toner, yellow toner, magenta toner, cyan toner, light cyan toner, and light magenta toner can be used to form a color image. The light cyan is a color which has the same hue as that of cyan but has a density lower than that of cyan. The light magenta is a color which has the same hue as that of magenta but has a density lower than that of magenta. The present embodiment employs toner having a number-average particle diameter of 1 μm to 25 μm. Note also that the toner of the present embodiment can be manufactured by a known manufacturing method such as a crushing method, a suspension polymerization method, an emulsion polymerization method, a solution polymerization method, or an ester extension polymerization method.

In the image forming apparatus 11 of the present embodiment, an amount of toner consumed is adjusted so that, in a case where a solid image (image area with an image area rate of 100%) is formed using the black toner, an amount of the toner in the image area falls in a range of 0.20 $g/cm^2$ to 0.40 $mg/cm^2$. Note that, in a case of using a full color image forming apparatus, an amount of toner consumed is adjusted so that an amount of toner in a solid image formed by use of process black (a state in which the three colors yellow, cyan, and magenta are combined) falls in a range of 0.60 $mg/cm^2$ to 1.2 $mg/cm^2$. This adjustment is made because (i) a transferred image does not have a sufficient image density in a case where a toner amount per color is less than 0.20 $mg/cm^2$ and (ii) in a case where a toner amount per color is more than 0.40 $mg/cm^2$, a transferred image causes a decrease in transfer efficiency, so that the toner is consumed wastefully.

(The Conductive Member **193*a*1**)

The conductive member **193*a*1 as illustrated in FIG. 3 can be press fitted in the through-hole on the inner circumferential side of the resin member 193*a*2** by means of insert molding or ultrasonic insert.

The insert molding, in which a metal insert can be used, enables manufacturing of a complicated, tough, and precise component in combination with antithetic properties such as (i) easy moldability and solubility of resin and (ii) rigidity, strength, and heat resistance of metal. It is also possible to improve long-term reliability by covering up a corrosive metal material (the conductive member **193*a*1) with resin (the resin member 193*a*2**).

It is preferable that knurled-type ultrasonic insert be employed among various types of ultrasonic insert techniques. The knurled-type ultrasonic insert will be described below. First, the outer circumferential surface of the conductive member 193*a*1 is knurled to have a cross pattern. The resin member 193*a*2 and the conductive member 193*a*1 are designed so that the resin member 193*a*2 has an inner diameter shorter, by about ϕ0.4 mm to ϕ1.0 mm, than an outer diameter of the conductive member 193*a*1. Then, the conductive member 193*a*1 is set on the through-hole of the resin member 193*a*2, and then ultrasonic vibrations and pressure are applied to the conductive member 193*a*1. This causes local frictional heat to be generated in the interface between the conductive member 193*a*1 and the resin member 193*a*2. At this moment, the conductive member 193*a*1 is inserted while melting the resin. As a result, the resin flows into the groove parts on the knurled surface. The resin thereafter coagulates again. This locks the conductive member 193*a*1, so that the insert is completed. Note that the knurling-type ultrasonic insert is described in detail in Non patent Literature 3.

The ultrasonic insert has at least the following advantages. Insert can be completed in a short period of time (usually one (1) second or less). A plurality of insert operations can be simultaneously performed. The resin is difficult to get broken or get cracked. Stress (residual stress) applied to the resin around the metal insert (the conductive member 193*a*1) is small. It is easy to control because of good reproducibility. It is also easy to automate because of the good reproducibility. There is no need to set, into a metallic mold, a metal insert (the conductive member 193*a*1). A metallic mold for the ultrasonic insert is less expensive than that for the insert molding. Insert cycle is short.

Note that undercut-type ultrasonic insert, which is disclosed in Non patent Literature 3, can be alternatively employed. The undercut-type ultrasonic insert is a technique based on the knurled-type ultrasonic insert and exhibits even better securing strength than that of the knurled-type ultrasonic insert. As disclosed in Non patent Literature 3, an undercut part is formed under a knurled surface of a metal insert (corresponding to the conductive member 193*a*1 in the present embodiment), and the metal insert is set into a resin hole. Then, the resin around the knurled surface is melted by means of ultrasonic vibrations. A molten resin flows into the grooves on the knurled surface, and part of the molten resin flows further downward to fill a groove of the undercut part. Since the undercut part has a deeper groove than that formed by the knurling, a stronger locking mechanism is obtained after the resin is coagulated again. This allows an improvement in tensile strength.

Note also that ultrasert-type ultrasonic insert, which is disclosed in Non patent Literature 3, can be alternatively employed. In this technique, as disclosed in Non patent Literature 3, a metal insert (corresponding to the conductive member 193*a*1 in the present embodiment) is processed to have an outer surface in a shape of a bamboo shoot, so that the molten resin can flow into and stay in the metal insert more easily. A bamboo shoot-shaped outer surface (a tapered portion having steps) of the metal insert can enhance the tensile strength brought by the locking and can also enhance strength with respect to rotary torque.

The strength obtained in the knurled-type ultrasonic insert varies because the molten resin is difficult to flow into the grooves smoothly. In contrast, the ultrasert-type ultrasonic insert can provide high strength because a large difference in levels of the steps on the outer surface of the metal insert allows the resin to flow in smoothly. Note that, since the grooves are larger, the strength with respect to rotary torque becomes larger.

The ultrasert-type ultrasonic insert has another advantage that positioning is easily carried out during the insert operation. This is because of the tapered shapes of the metal insert and the resin hole. Further, according to the ultrasert-type ultrasonic insert, the resin can be heated at the steps on the surface of the metal insert, so that an efficient melting state can be secured. Still further, according to the ultrasert-type ultrasonic insert, a contact surface has strength and the insert operation can therefore be performed in a short period of time, so that stable strength can be attained. The ultrasert-type ultrasonic insert has a further advantage that the tapered shapes of the metal insert and the resin hole prevent the molten resin from being extruded downward, so that the locking can be performed smoothly.

SUMMARY OF THE PRESENT EMBODIMENT

A feature of a charging roller of the present embodiment resides in including: a conductive shaft; a charge emission member provided to the shaft; and a gap securing member, provided to the shaft, which (i) protrudes toward the photoreceptor drum so as to be closer to the photoreceptor drum than the charge emission member is to the photoreceptor drum and (ii) is in contact with the photoreceptor drum so as to secure a gap between the charge emission member and the photoreceptor drum, a conductive part of the gap securing member and the shaft being bonded to each other by electrically releasing adhesive, so that the gap securing member is provided to the shaft. According to the configuration of the present embodiment, it is possible to replace the gap securing member with a new one, by applying an electric current between the gap securing member and the shaft so as to remove the gap securing member from the shaft, and then by bonding the new gap securing member to the shaft by means of the electrically releasing adhesive. That is, with the configuration of the present embodiment, it is possible to replace the gap securing member by a new one, without reducing an effective width of a charge emission surface of the charge emission member. This enables a larger number of replacements of the gap securing member, thereby enabling the charging roller to be used for a long time.

The charging roller of the present embodiment can employ a configuration in which the gap securing member includes a ring resin member and a ring conductive member that serves as the conductive part, the conductive member is press fitted in a through-hole on an inner circumferential side of the ring resin member, the shaft is inserted in a through-hole on an inner circumferential side of the conductive member, and the inner circumferential surface of the conductive member and the shaft are bonded to each other by the electrically releasing adhesive. In the charging roller of the present embodiment, the conductive member preferably be composed of any one of brass, stainless steel, aluminum, and iron.

Note that an electrophotographic image forming apparatus of the present embodiment has a feature of including the charging roller. The electrophotographic image forming apparatus of the present embodiment preferably comprises a drive gear for giving a torque to the shaft of the charging roller.

Further note that a method for recycling a charging roller of the present embodiment has a feature of including the steps of: releasing the gap securing member from the shaft by (a) connecting one of electrodes of a power source with the shaft, (b) connecting the other of the electrodes of the power source with the conductive part, and (c) applying an electric current to the shaft and the conductive part; and bonding another gap securing member to the shaft by means of the electrically releasing adhesive. This makes it possible to replace the gap securing member by a new one, without reducing an effective width of a charge emission surface of the charge emission member. This enables a larger number of replacements of the gap securing member, thereby enabling the charging roller to be used for a long time.

The present invention is not limited to the above-described embodiments but allows various modifications within the scope of the claims. Any embodiment derived from an appropriate combination of the technical means disclosed in the different embodiments will also be included in the technical scope of the present invention.

The charging roller of the present embodiment is applicable to an electrophotographic image forming apparatus such as a copying machine, a multifunction printer, a printer, or a facsimile machine.

REFERENCE SIGNS LIST

10: multifunction printer
11: image forming apparatus
17: photoreceptor drum
19: charging roller
191: shaft
192: charge emission member
193: gap securing member
193*a*: gap securing member
193*b*: gap securing member
193*a*1: conductive member (conductive part)
193*a*2: resin member
500: DC power source (power source)

The invention claimed is:

1. A charging roller comprising:
a conductive shaft;
a charge emission member provided to the shaft; and
a gap securing member, provided to the shaft, which (i) protrudes toward a photoreceptor drum so as to be closer to the photoreceptor drum than the charge emission member is to the photoreceptor drum and (ii) is in contact with the photoreceptor drum so as to secure a gap between the charge emission member and the photoreceptor drum;
a conductive part of the gap securing member and the shaft being boded to each other by electrically releasing adhesive, so that the gap securing member is provided to the shaft;
the gap securing member including a ring resin member and a ring conductive member that serves as the conductive part,
the conductive member is press fitted in a through-hole on an inner circumferential side of the ring resin member,
the shaft is inserted in a through-hole on an inner circumferential side of the conductive member, and
the inner circumferential surface of the conductive member and the shaft are bonded to each other by the electrically releasing adhesive.

2. The charging roller as set forth in claim 1, wherein the conductive member is made of brass, stainless steel, aluminum, or iron.

3. An image forming apparatus comprising a charging roller, said charging roller including:
a conductive shaft;
a charge emission member provided to the shaft; and
a gap securing member, provided to the shaft, which (i) protrudes toward the photoreceptor drum so as to be closer to the photoreceptor drum than the charge emission member is to the photoreceptor drum and (ii) is in contact with the photoreceptor drum so as to secure a gap between the charge emission member and the photoreceptor drum,
a conductive part of the gap securing member and the shaft being bonded to each other by electrically releasing adhesive, so that the gap securing member is provided to the shaft; and
the gap securing member including a ring resin member and a ring conductive member that serves as the conductive part,
the conductive member is press fitted in a through-hole on an inner circumferential side of the ring resin member;
the shaft is inserted in a through-hole on an inner circumferential side of the conductive member and,
the inner circumferential surface of the conductive member and the shaft are bonded to each other by the electrically releasing adhesive.

4. An image forming apparatus as set forth in claim 3, further comprising a drive gear for giving a torque to the shaft.

5. The image forming apparatus as set forth in claim 3, wherein the conductive member is made of brass, stainless steel, aluminum, or iron.

* * * * *